United States Patent [19]

Nobutoki et al.

[11] Patent Number: 4,695,813

[45] Date of Patent: Sep. 22, 1987

[54] POLARIZED ELECTROMAGNETIC RELAY

[75] Inventors: Kazuhiro Nobutoki; Kenji Ono, both of Matsusaka, Japan

[73] Assignee: Matsushita Electric Works, Ltd., Japan

[21] Appl. No.: 836,735

[22] Filed: Mar. 6, 1986

[30] Foreign Application Priority Data

Mar. 25, 1985 [JP] Japan ..... 60-60087

[51] Int. Cl.[4] ..... H01H 51/22

[52] U.S. Cl. ..... 335/78; 335/80; 335/124; 335/128; 335/181

[58] Field of Search ..... 335/78, 80, 81, 83, 335/124, 128, 180, 181, 203

[56] References Cited

U.S. PATENT DOCUMENTS

| | | | |
|---|---|---|---|
| 4,064,471 | 12/1977 | Schuessler | 335/229 |
| 4,160,965 | 7/1979 | Kobler | 335/230 |
| 4,182,998 | 1/1980 | Mueller | 335/151 |
| 4,286,244 | 8/1981 | Schuessler et al. | 335/230 |
| 4,551,698 | 11/1985 | Aidn | 335/78 |

FOREIGN PATENT DOCUMENTS

| | | |
|---|---|---|
| 0100165 | 2/1984 | European Pat. Off. . |
| 2148377 | 10/1971 | Fed. Rep. of Germany . |

*Primary Examiner*—L. A. Goldberg
*Assistant Examiner*—Lincoln Donovan
*Attorney, Agent, or Firm*—Stevens, Davis, Miller & Mosher

[57] ABSTRACT

A polarized electromagnetic relay includes a flat-shaped armature pivotally supported at its center, an electromagnet with a pair of pole members extending toward the armature ends on either side of the center pivot axis, and a three-pole magnetized permanent magnet bridging between the pole members in generally parallel relation with the armature. A pair of movable contact springs extends along the lateral sides of the armature and joined at its center portion to the armature to be movable therewith. Integrally formed with each movable contact spring is a pivot arm which extends transversely from the center thereof and is fixedly secured to a relay casing. The pivot arm defines itself a resilient torsion element of limited deformability by which the armature is supported on the relay casing and is permitted to pivot about the center pivot axis for movement between the two angular positions.

7 Claims, 8 Drawing Figures

POLARIZED ELECTROMAGNETIC RELAY

BACKGROUND OF THE INVENTION

1. Field of the Invention

The present invention relates to a polarized electromagnetic relay, and more particularly to such a relay with a swingable armature pivotally supported at its center for movement between two contact operating positions.

2. Description of the Prior Art

Polarized electromagnetic relays with a swingable armature pivoted at its center are known, for example, as disclosed in German Patent Publication (Auslegeschrift) No. 2,148,377 and in U.S. Pat. Nos. 4,160,965 and 4,286,244. In such relays, the center-pivoted armature is held on a supporting member by a pair of pivot pins which are rotatably inserted in corresponding bearing holes. This pivotal connection of the armature relies upon the conventional friction coupling and therefore is naturally subject to wearing, which causes a misalignment of the pivot axis of the armature during an extended number of relay operations and therefore reduces accuracy in the swinging movement of the armature, resulting in unreliable contacting operation. Such misalignment becomes increasingly critical for a miniaturized relay which is required to effect the contacting operation only at a limited stroke of the armature movement, and therefore should be eliminated for the fabrication of miniature relays.

Besides, the armature and the movable contact springs are mostly preferred to be combined into a one-piece structure for easy fabrication of the relay, particularly for miniature relays. To this end, it has been a usual practice to carry the movable contact springs on the armature, as taught in the above U.S. Pat. No. 4,286,244. However, the armature is still required to include the pivot pins separately formed from the armature or movable contact springs, which is not sufficient in reducing the number of components associated with the armature, thus failing to provide an efficient design for miniaturization of the relay.

SUMMARY OF THE INVENTION

The present invention has been accomplished in view of the above problems and provides improved and advantageous constructional features for relays with a center-pivoted armature, particularly for miniature relays with such an armature. The relay in accordance with the present invention comprises an elongate armature pivotally supported at its center to pivot about a center axis for angular movement between two contact operating positions. The armature is magnetically coupled to an electromagnet having opposed pole members connected by a core carrying exciter coil means and extending from the ends of the core toward the ends of the armature on either side of the pivot axis. A three-pole magnetized permanent magnet bridges between the opposed pole members of the electromagnet in generally parallel relation to the armature so that it forms with the armature two independent magnetic circuits each serving to hold the armature in each of the contact operating positions. A pair of movable springs each having contact ends on its longitudinal ends extend along the lateral sides of the armature with the center portions being coupled to the armature so that the movable contact springs are movable with the armature. Each contact spring is integrally formed at its center with a transversely extending pivot arm which is fixed to a portion of the casing for supporting the armature thereon. The pivot arm defines itself a resilient torsion element of limited deformability which permits the armature to pivot about the center axis for movement between the two contact operation positions. With the use of the pivot arms of limited torsional deformability, the armature can be well pivotally supported without resorting to the conventional bearing means relying on frictional coupling. Thus, the pivot arms of the armature can be free from wearing associated with the conventional bearing, whereby the armature can have accurate and reliable angular movement over an extended operational life.

Accordingly, it is a primary object of the present invention to provide a polarized electromagnetic relay which ensures an accurate and reliable armature operation over an extended operational life.

Also with the integral formation of the pivot arm with each of the movable contact springs which in turn join with the armature, the armature can be supported by better utilization of the material from which the movable contact spring is made, reducing the number of relay components employed, in addition to that the pivot arm integral with the movable contact spring serves as a common contact leading to a corresponding terminal member mounted outside of the casing.

It is therefore another object of the present invention to provide a polarized electromagnetic relay which can reduce the number of relay components for easy fabrication of the relay.

Each movable contact spring has at both its ends respective contact ends in alternate contact with complementary fixed contacts mounted on the casing at a desired contact pressure therebetween. Such a contact pressure results from the flexibility inherent to the material of the contact spring and can be easily adjusted by bending the same along its length. While on the other hand, since the pivot arm having the torsional deformability may serve as an element for determining a response voltage at which the armature is actuated, the balancing or tuning of the armature movement can be made by the manipulation of the pivot arms. Considering that the pivot arm extends transversely of the movable spring, the torsional deformability can act substantially independently of the flexibility given to the contact spring along its length so that the contact pressure and the balancing can be separately adjusted without causing interference therebetween.

It is therefore a further object of the present invention to provide a polarized electromagnetic relay in which the contact pressure and response sensitivity can be easily and separately adjusted for a desired relay operation.

In a preferred embodiment, the permanent magnet is formed on its end half portions respectively with oppositely inclined surfaces confronting the armature so that the permanent magnet is closer to the armature at its center than at the longitudinal ends when the armature is in a neutral position where the armature has its ends evenly spaced from the corresponding pole members. The inclined surface on each end half portion of the permanent magnet is advantageous in that the armature in either of two angularly disposed positions can have its one end half portion brought into parallel relation to the adjacent inclined surface so as to be equally closed at its end to the inclined surface, eliminating the magnetic loss in said magnetic circuits circulating through the permanent magnet and the armature and thereby producing a maximum magnetomotive force between the armature and the permanent magnet at a minimum magnetic power of the permanent magnet, which is most suitable for obtaining an increased contact pressure with a limited size of the permanent magnet.

It is therefore a still further object of the present invention to provide a polarized electromagnetic relay in which the armature forms with the permanent magnet an effective magnetic system for actuation of the armature.

Said three-pole magnetized permanent magnet is made of a magnetic material essentially composed of Fe-Cr-Co alloy material. Such magnetic material is known to have higher recoil permeability [$\mu_r$] in its anisotropic direction as well as in a direction perpendicular thereto, which is most suitable for effectively magnetizing this particular type of three-pole permanent magnet as well as for effectively exerting its magnetomotive force in the armature operation. Also, the material can be subjected to a roll forming so that it can be easily shaped into any advantageous configuration in designing an effective magnetic system including the above configuration having the oppositely inclined surface on each end half portion of the permanent magnet.

It is therefore a further object to provide a polarized electromagnetic relay which incorporates a permanent magnet of superior magnetic characteristics.

These and still other objects and advantageous features will become more apparent from the following description of a preferred embodiment of the present invention when taken in conjunction with the accompanying drawings.

DESCRIPTION OF THE PREFERRED EMBODIMENT

Figure 1:
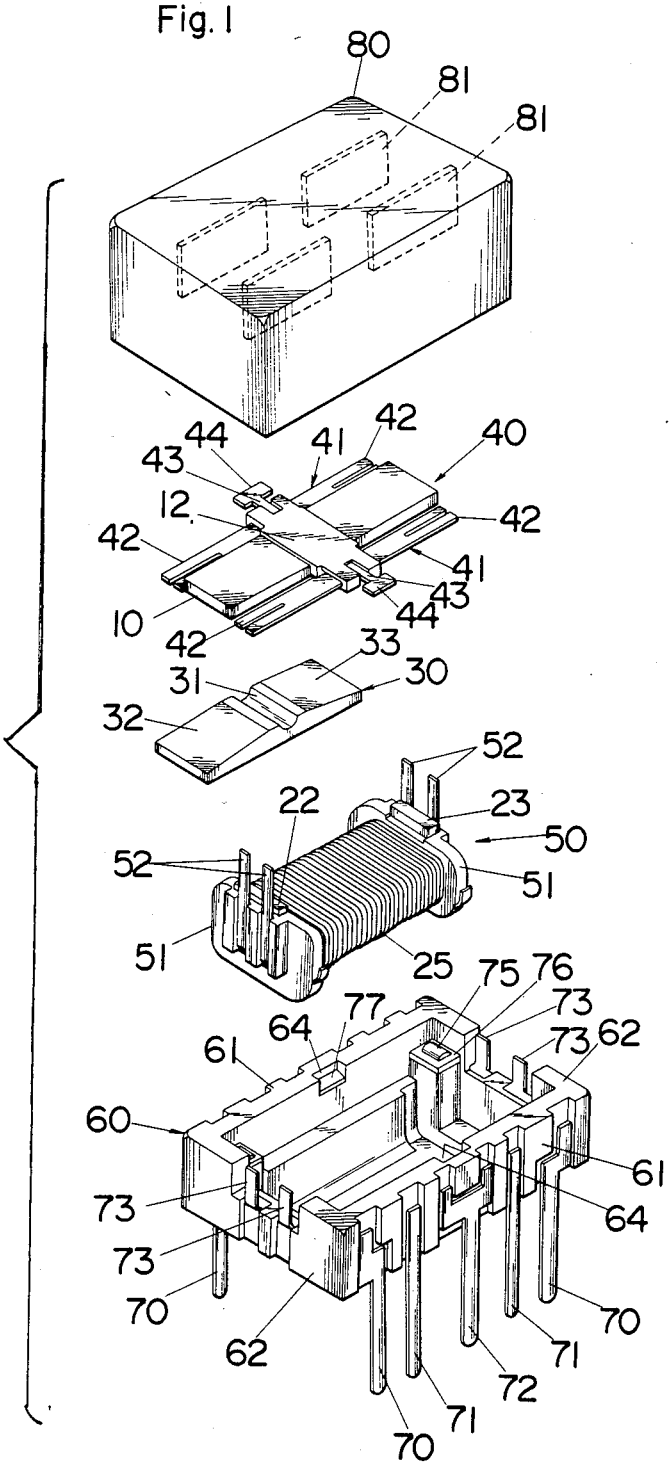
FIG. 1 is an exploded perspective view of a polarized relay to which the present device is adapted.

Referring now to FIG. 1, there is shown a polarized electromagnetic relay embodying the present invention. The relay in this embodiment is of bistable operation and of double-pole double-throw contact arrangement. The relay comprises a casing 60 of plastic material for receiving therein an armature unit 40 and a coil unit 50. Said armature unit 40 is made as a one-piece structure having a flat-shaped armature 10 and a pair of movable contact springs 41 extending along the lateral sides thereof. Each movable spring 41 is kept in parallel relation to the armature 10 within the same plane thereof and connected at its center portion to the armature 10 by a plastic molding 12 so as to be movable therewith. Said coil unit 50 is also made as a one-piece construction including an electromagnet 20 and a bar-shaped three-pole magnetized permanent magnet 30. The electromagnet 20 comprises a U-shaped yoke 21 with a pair of parallel pole members or legs 22 and 23 connected by a core 24, a pair of exciter coils 25 wound around the core 24. Said permanent magnet 30 extends between the upper ends of the pole members 22 and 23 with its center in register with a pivot axis of the armature 10, and is magnetized to have the same poles, for example south poles S, at its ends and the opposite pole, or north pole N intermediate the ends.

The armature and coil units 40 and 50 are received in a casing 60 which is molded from a plastic material into a top-opened rectangular shallow box enclosed by side walls 61 and end walls 62. A plurality of terminal pins 70, 71 and 72 extend outwardly of the casing 60 with its portions molded in the side and end walls of the casing 60. Such terminal pins 70, 71 and 72 are formed respectively with integral extensions which extend through the side and end walls 61 and 62, as indicated by dot lines in FIG. 3, to reinforce the casing 60 and define at the inward end separate elements respectively for electrical connection with the electromagnet 20 and the movable contact springs 41. Said terminal pins 70, 71 and 72 are bent at a right angle to the plane of the casing 60 after being molded to extend downwardly thereof.

Formed in the upper surface of the permanent magnet 30 is a round groove 31 in which is seated a center projection 11 on the underside of the armature 10 for supporting the armature 10 on the permanent magnet 30. The permanent magnet 30 is made of magnetic material such as Fe-Cr-Co alloy having a higher recoil permeability [$\mu_r$] in its anisotropic direction as well as in a direction perpendicular thereto, permitting easy magnetization for this particular type of three-pole magnet and formation of efficient magnetic circuits with the armature 10 due to its higher magnetomotive force developed in the direction of the length of the permanent magnet 30 as well as in the direction perpendicular thereto.

The armature 10 is pivotable about its center axis for movement between two angular positions at each of which the armature 10 has its one end moved to the upper end of the adjacent pole member 22, 23 and has the other end moved away from the upper end of the adjacent pole members 23, 22. The three-pole permanent magnet 30 is cooperative with the armature 10 to form first and second flux paths of identical length indicated respectively by lines X and Y in FIGS. 4 and 5, said first and second flux paths X and Y exerting their own magnetomotive forces for moving the armature 10 about the center pivot axis in the opposite directions and holding it in either of two angular positions.

The upper face of the permanent magnet 30 confronting the armature 10 is configured to have on its end half portions oppositely inclined surfaces 32 and 33 extending downwardly and outwardly from its center to its ends. With the provision of the inclined surfaces 32 and 33, the armature 10 can have its end half portion be kept in parallel relation with the adjacent inclined surface 32, 33 so that each half portion of the armature 10 can be substantially equally closed at its ends to the permanent magnet 10 to thereby reduce the magnetic loss in either the first or second flux paths as much as possible, giving rise to increased efficiency of the magnetic circuits.

Figure 2:
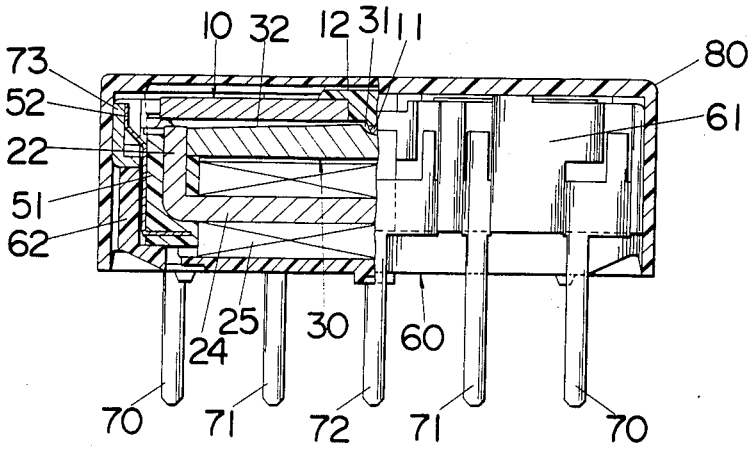
FIG. 2 is a front view partly in cross section of the above relay.

Said coil unit 50 into which the electromagnet 20 and permanent magnet 30 are integrated is provided with end flanges 51 of plastic material each carrying a pair of upwardly extending conductors 52 electrically coupled at their lower ends to the respective exciter coil 25 within the unit 50. Said pole members 22 and 23 of the electromagnet 20 extend upwardly through the end flanges 51 to form pole faces at the respective upper ends thereof for magnetic coupling with the armature 10. The permanent magnet 30 extends between the exposed upper ends of the pole members 22 and 23 to be fixed thereto, as shown in FIG. 2.

Each pair of conductors 52 on the coil unit 50 are connected to corresponding pair of tabs 73 on each end wall 62 by staking, brazing or other conventional manner, the tabs 73 being integrally connected to the respective terminal pins 70 through said extensions molded in the end walls 62.

Two sets of said fixed contacts 75 are formed on separate carrier plates 76 supported at the inside corners of the casing 60 and connected integrally to the corresponding terminal pins 71 through the extensions embeded in the side walls 61. Formed in the upper and inner end of each side wall 61 at the center of its length is a cavity 64 within which is seated a contact piece 77 for electrical connection with each of said movable common contact springs 41, said contact piece 77 being formed as an integral part of said extension leading through the side wall 61 to the corresponding terminal pin 72.

Each of said movable common contact springs 41 is in the form of an elongate leaf spring having its contact ends 42 bifurcated to add increased flexibility thereto. Formed integrally with each contact spring 41 is a pivot arm 43 with an enlarged flap 44 which extends outwardly from the center of its length at a right angle with respect to the lengthwise axis thereof. These pivot arms 43 are in alignment with said projection 11 on the underside of the armature 10, the projection 11 being integral with the molding 12 and being rotatably received in said groove 31 for supporting the armature 10 on the permanent magnet 30.

Figure 7:
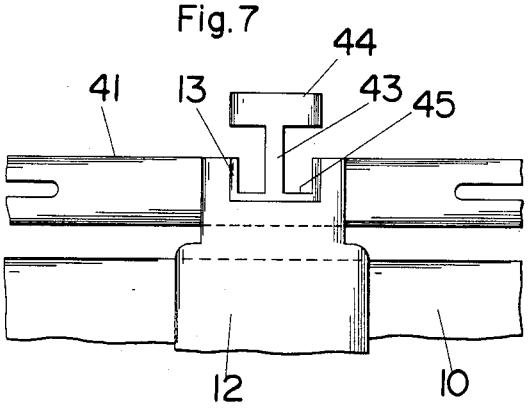
FIG. 7 is a fragmentary plan view of the armature unit.

The contact springs 41 are embeded at the center portion into the ends of said molding 12 extending transversely of the armature 10 so as to be integrally supported thereby. As best shown in FIG. 7, the pivot arm 43 extends from the bottom of a notched portion 45 in the center of the spring 41 and has a narrower width than the rest of the contact spring 41, the entire pivot arm 43 and the substantial area of the notched portion 45 being exposed within a corresponding recess 13 in the end of the molding 12. It is by the pivot arms 43 that the armature 10 is pivotally supported to the casing 60 for effectuating the contacting operation upon energization of the electromagnet 20. That is, the armature unit 40 is assembled into the relay with the flaps 44 at the free ends of the pivot arms 43 being fixedly fitted within said cavities 64 in the upper end of the side walls 61 and can pivot about the axis of the pivot arms 43 as elastically deforming the pivot arms 43 about its axis. In this sense, each of the pivot arms 43 having a narrower width define themselves a resilient torsion elements of limited deformability whereby the armature 10 is permitted to pivot about the axis within a limited angular movement. When the armature unit 40 is assembled into the casing 60, said flaps 44 are brought into contact respectively with the contact pieces 77 in the cavities 64 for electrical connection between the movable contact springs 41 and the corresponding terminal pins 72. With this arrangement, the pivot arms 43 themselves can serve not only as the pivot axis but also as the electrical conductor means or common contacts, which reduces the number of parts employed in the armature unit 40 in addition to that the pivot arms 43 are integrally formed with the movable springs 41.

Figure 4:
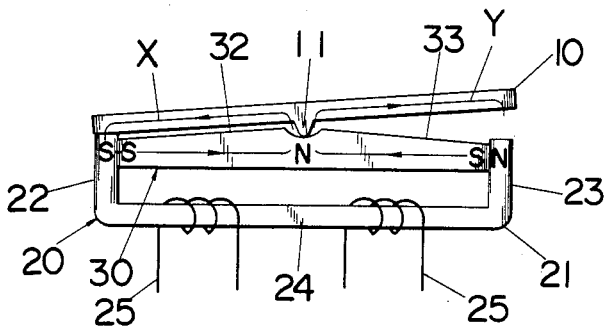
FIG. 4 is a schematic view showing the armature held in one of its contact operating positions.
Figure 5:
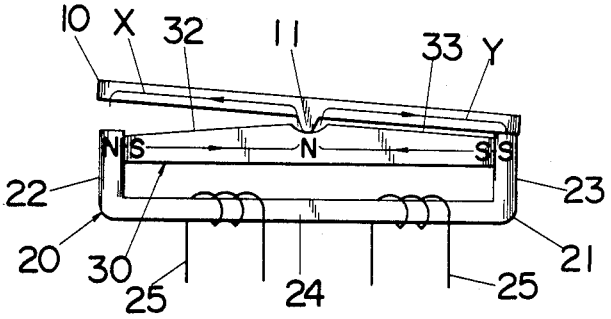
FIG. 5 is a schematic view showing the armature held in the other contact operating position.
Figure 6:
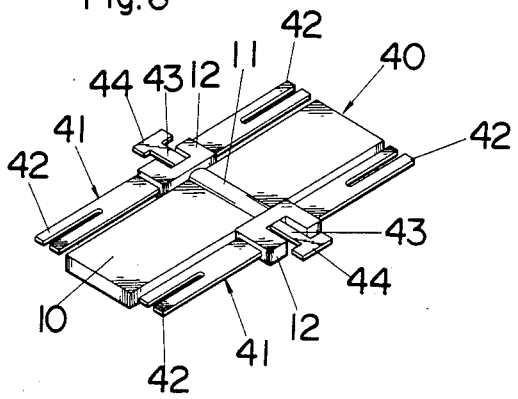
FIG. 6 is a perspective view of the armature unit with the movable contact springs of the above relay as viewed from the underside.

In operation, when the electromagnet 20 is de-energized the armature 10 is held or kept latched in either of the two stable positions of FIG. 4 and 5 respectively by magnetomotive forces due to said first and second flux paths X and Y which circulate through the end half portions of the armature 10 from the permanent magnet 30, respectively. When the armature 10 is required to move from the position of FIG. 4 to the position of FIG. 5, the electromagnet 20 is energized by one of the exciter coils 25 receiving a current of such a polarity as to produce magnetic flux additive to the second flux path Y, in this instance, as to produce a south pole S on the pole member 23 at the right hand end of the electromagnet 20, at which occurrence the resulting added magnetomotive force from second flux path Y and from the electromagnet 20 exceeds the force from the first flux path X so that the armature 10 is rotated about its center pivot axis to move into the position of FIG. 5 against the torsional force developed in the pivot arms 43 and is latched to this position after the de-energization of the electromagnet 20. For reversing the armature 10, a current of opposite polarity is fed to the other exciter coil 25 of the electromagnet 20 to add the resulting magnetic flux to the first flux path X, or to produce a south pole S on the pole member 22 at the left hand end of the electromagnet 20, whereby the armature 10 is returned to the position of FIG. 4 against the bias of the pivot arms 43 and the movable springs 41 to be kept stable thereat until the electromagnet 20 is again energized. Although the two exciter coils 25 are used in the present invention each for receiving current of opposite polarity, a single exciter coil 25 may be used for selectively receiving currents of opposite polarity.

Figure 8:
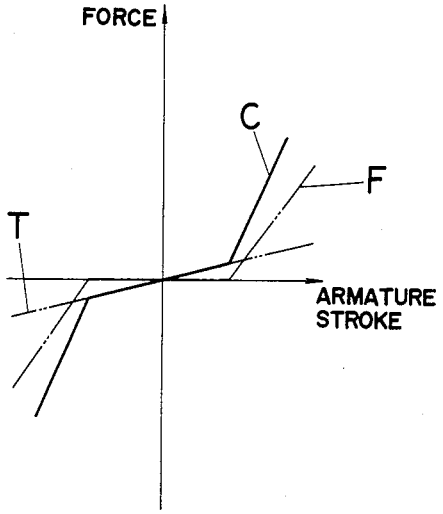
FIG. 8 is a graphical representation of the spring forces acting upon the armature during the stroke of the armature unit.

In the meanwhile, since the pivot arm 43 gives torsional spring force to the armature 10 in its reversing stroke to either of the two stable positions, it is possible to carry out balancing or tuning of the armature operation to a desired response voltage by adjusting the spring constant thereof such as by selecting the material and/or the configuration of the pivot arms 43. In this connection, the pivot arm 43 extending transversely of the contact spring 41 can have the torsional spring characteristic about its axis, which is substantially independent of the flexing motion along the length of the spring 41 required for providing a suitable contacting pressure. With this result, the adjustments of the response sensitivity and the contact pressure can be carried out independently and separately, despite that the pivot arm 43 is integrally formed with the contact spring 41. The torsional spring force T about the axis of the pivot arm 43, the flexure spring force F along the length of the movable contact spring 41, and the composite force C thereof acting on the armature unit 40 as return spring means for the armature unit 40 are shown in FIG. 8 to be as the functions of the armature stroke.

Figure 3:
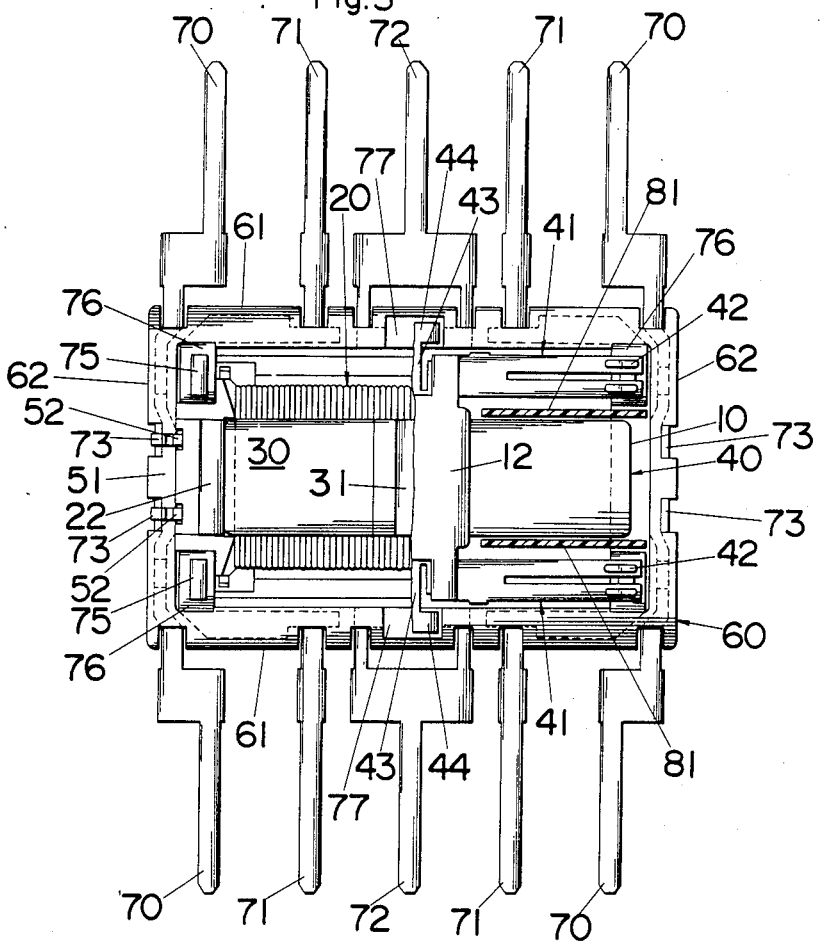
FIG. 3 is a top view partly in cross section of the above relay with its terminal pins extending horizontally in a pre-assembled condition of the relay.

A cover 80 fitted over the casing 60 is provided with a plurality of insulation walls 81 which depend from the top wall to extend into the respective gaps between the armature 10 and the contact ends of each contact springs 41 for effective insulation therebetween, as best shown in FIG. 3.

What is claimed is:

1. In a polarized electromagnet relay including:

a casing;

an elongate armature pivotally supported at its central portion to be movable about a center pivot axis for angular movement between two contact operating positions;

an electromagnet received in the casing, said electromagnet having a core, exciter coil means about the core, and a pair of pole members extending from the ends of the core toward the ends of the armature on either side of the pivot axis;

a bar-shaped three-pole magnetized permanent magnet disposed between the free ends of the pole members in closely adjacent relationship to the armature, said permanent magnet being magnetized to have the same poles at its lengthwise ends and to have the opposite pole intermediate its end;

a pair of movable contact springs carried by the armature to be moved into and out of contact with corresponding fixed contacts mounted on the casing; the improvement comprising:

each of said movable contact spring extending along each lateral side of the armature and fixedly connected thereto at the portion intermediate the ends thereof so as to be movable together with the armature, each movable contact spring being formed at the intermediate portion thereof with a transversely extending pivot arm which joins fixedly with a portion of the casing, said pivot arm being integral with the movable contact spring to define itself a resilient torsion element of limited deformability whereby the armature is permitted to pivot about the axis of the pivot arms for movement between the two contact operating positions.

2. A polarized electromagnetic relay as set forth in claim 1, wherein said pivot arm is in electrical connection with a contact piece mounted on the casing so that the movable contract spring is electrically connected through said contact piece with a corresponding terminal member extending outwardly of the casing.

3. A polarized electromagnetic relay as set forth in claim 1, wherein each of said movable common contact springs is struck from a single sheet of electrically conductive material to have said pivot arm integrally formed therewith, each contact spring being connected at its intermediate portion adjacent the pivot arm to the armature by plastic molding to provide a one-piece armature unit with the contact spring on either side of the armature.

4. A polarized electromagnetic relay as set forth in claim 3, wherein each contact spring has on both its ends contact means respectively engageable with the fixed contacts mounted on the casing.

5. A polarized electromagnetic relay as set forth in claim 3, wherein each contact spring has a notched portion in the intermediate portion between the ends, said pivot arm extending outwardly from the bottom of the notched portion in perpendicular relation to the length of the contact spring and having a width smaller than the rest of the contact spring, and said pivot arm having at its free end an enlarged flap which is fixedly fitted within a corresponding cavity formed in the casing and is in electrical contact with a contact piece seated in said cavity for electrical connection between the contact spring and a terminal member outside of the casing.

6. A polarized electromagnetic relay as set forth in claim 1, wherein the surface of the permanent magnet confronting the armature is inclined so that the permanent magnet is closer to the armature at its center than at the longitudinal ends when the armature is at a neutral position where the armature has its ends evenly spaced from the adjacent pole members of the electromagnet.

7. A polarized electromagnetic relay as set forth in claim 1, wherein the permanent magnet is made of a magnetic material essentially composed of Fe-Cr-Co alloy.

* * * * *